US007645198B2

(12) United States Patent
Van Heerden

(10) Patent No.: US 7,645,198 B2
(45) Date of Patent: Jan. 12, 2010

(54) GOLF SWING TRAINING DEVICE

(76) Inventor: Andre P. Van Heerden, 650 The Village, #209, Redondo Beach, CA (US) 90277

( * ) Notice: Subject to any disclaimer, the term of this patent is extended or adjusted under 35 U.S.C. 154(b) by 0 days.

(21) Appl. No.: 12/053,585

(22) Filed: Mar. 22, 2008

(65) Prior Publication Data

US 2008/0234062 A1 Sep. 25, 2008

Related U.S. Application Data

(60) Provisional application No. 60/919,452, filed on Mar. 22, 2007.

(51) Int. Cl.
*A63B 69/36* (2006.01)

(52) U.S. Cl. ..... 473/216; 473/277

(58) Field of Classification Search ..... 473/207, 473/215, 266, 269, 271, 272, 273, 275, 277
See application file for complete search history.

(56) References Cited

U.S. PATENT DOCUMENTS 1,561,960 A 11/1925 Ungar
3,215,438 A * 11/1965 Sheldon et al. ..... 473/277
5,050,885 A 9/1991 Ballard
5,125,663 A 6/1992 Lurowist
5,288,074 A * 2/1994 Scheurer ..... 473/277
5,456,470 A * 10/1995 Scheurer ..... 473/277
5,688,212 A 11/1997 Walker
5,762,565 A * 6/1998 Milam et al. ..... 473/271
5,984,797 A 11/1999 Kessler
6,431,991 B1 8/2002 Kossnar
6,551,196 B1 4/2003 Kossnar
6,843,730 B1 1/2005 Bellagamba
7,066,828 B2 * 6/2006 Lee et al. ..... 473/277

* cited by examiner

*Primary Examiner*—Nini Legesse

(57) ABSTRACT

A golf swing training device is configured to prevent lateral movement of a golfer's hips such as during the backswing, downswing and/or follow-through portions of the golfer's swing. In addition, the golf swing training device is configured to prevent reverse rotation of the golfer's hips such as during the backswing portion. The training device may comprise a seat assembly and a horizontal arm assembly. The seat assembly is configured to be mounted to the golfer's hips and defines opposing lateral seat sides. The horizontal arm assembly is coupled to the seat assembly and is configured to be pivotable about a seat pivot axis located adjacent one of the seat sides. The horizontal arm assembly is configured to prevent reverse pivoting of the seat assembly such that reverse rotation of the golfer's hips is prevented.

18 Claims, 9 Drawing Sheets

GOLF SWING TRAINING DEVICE

CROSS-REFERENCE TO RELATED APPLICATIONS

The present application claims priority to U.S. Provisional Application No. 60/919,452 entitled GOLF SWING TRAINING DEVICE filed on Mar. 22, 2007, the entire contents of which is expressly incorporated by reference herein.

STATEMENT RE: FEDERALLY SPONSORED RESEARCH/DEVELOPMENT (Not Applicable)

BACKGROUND

The present invention relates generally to golf swing training apparatus and, more particularly, to a uniquely configured mechanical swing training device adapted to develop a proper golf swing in order to maximize driving distance of the golf ball as well as improve the consistency with which the golfer swings the golf club. More specifically, the swing training aid disclosed herein increases potential energy or power that is generated by core (i.e., spine) rotation during the backswing and increases momentum at the beginning of the downswing. In addition, the swing training aid prevents lateral or sideways movement in order to improve accuracy in directional flight of the ball by preventing/limiting the swaying of the golfer's hips. Furthermore, the swing training aid prevents reverse rotation (i.e., away from the golf ball) of the golfer's hips but allows forward rotation of the golfer's hips at the start of the downswing such that the golfer is forced to use the lower portion of his body in order to release the potential energy stored during the back swing.

Included in the prior art are a variety of golf swing training aids directed toward improving a golfer's swing. Many of such prior art golf training devices are directed toward stabilizing a particular portion of the golfer's body such as the lower portion, hips, upper torso and/or head in such a manner as to promote certain body movements which are believed to improve the golfer's swing. For example, U.S. Pat. No. 5,050,885 issued to Ballard, et al discloses a golf swing training apparatus having a saddle for attachment to the golfer's hips.

The saddle is connected to a traveler which is configured to move laterally on a tract that is mounted on a pivotal connecting assembly supported by a base. The saddle is also connected to a spring and hinge assembly about which the saddle rotates during the user's backswing as well as during the follow through portion of the golfer's swing. The Ballard patent specifically discloses that the golfer's hips move laterally to the right (i.e., for a right handed golfer) during the golf swing. Additionally, the Ballard patent specifically discloses that the golfer's hip rotates up to 45° in the reverse direction during the backswing as is illustrated in FIGS. 19-26 which pictorially represent a golfer using the Ballard training apparatus.

U.S. Pat. Nos. 6,551,196 and 6,431,991 as well as U.S. Pat. No. 5,984,797 all including Kossnar as at least one of the co-inventors and describing a golf swing training system having a pelvic belt which wraps around the golfer's hips. The belt is pivotally connected at one end to a base which is mounted on a supporting surface. The belt guides the golfer's hip rotation during the backswing, downswing, and follow through. The pivot axis is located to the rear of a golfer's right leg (i.e., for a right handed golfer) during the backswing and downswing and allowing pivoting about an axis located behind the golfer's left leg during the follow through. In this regard, the above noted family of patents specifically encourages rotation of the golfer's hips during the backswing and which is illustrated in FIG. 14 of U.S. Pat. No. 5,984,797.

U.S. Pat. No. 6,843,730 issued to Bellagamba discloses a golf training apparatus having a frame with a base and an upright frame portion. The apparatus includes a back support attached to the upright frame apparatus and includes a Velcro fastener portion. The apparatus further includes a belt for attaching to the golfer also having a complimentary Velcro fastener portion which is preferably aligned for attachment to the back support fastener portion. As illustrated in FIG. 1 of the Bellagamba patent, the training apparatus is specifically adapted to maintain the golfer's head, feet, legs and rear side to provide proper stance in developing a proper golf swing. Notably, the Bellagamba patent does not appear to disclose a means for preventing reverse rotation of a golfer's hips during a golf swing.

U.S. Pat. No. 5,688,212, issued to Walker discloses a golf swing training apparatus which is mountable on a supporting surface such as the ground and which includes a vertical support having upper and lower rotational assistance assemblies. Each of the assemblies is vertically adjustable in alignment with the golfer's pectoral (i.e., chest) and hip levels. More specifically, the Walker patent specifically discloses that rotational resistance of the upper and lower torso (i.e., chest and hip levels) is adjustable in the forward and reverse rotational directions.

U.S. Pat. No. 5,125,663, issued to Lurowist discloses a golf swing training apparatus having a base with a strut extending upwardly therefrom, a support seat (i.e., bicycle seat) mounted on the strut and rotational coupling allowing rotation of the support seat. In this regard, the Lurowist reference specifically discloses that the rotational coupling rotates in proportion to rotation of the golfer's hips and, in this regard, is directed toward promoting hip rotation about a nearly vertical axis while maintaining a fixed location of the golfer's groin during the golf swing. Notably, the Lurowist reference specifically discloses and illustrates in FIG. 15 that the training apparatus allows for reverse rotational motion of the golfer's hips such as during the backswing portion.

German Patent Application No. DE 19630820 likewise discloses a frame apparatus extending upwardly from a base which may be mounted on a support such as the ground. The frame includes a subframe member pivotally mounted thereto and which appears to allow relative hip rotation of a golfer. More specifically, the German patent appears to disclose that the frame permits reverse rotation of the golfer's hips during the backswing as the frame rotates about a single axis of rotation.

U.S. Pat. No. 1,561,960 issued to Ungar discloses a golf positioning apparatus having a base plate with a pole or standard extending upwardly therefrom. An abutment is pivotally mounted on the pole and which is adapted to limit certain movements of the golfer's body during a golf swing. More specifically, the Ungar reference discloses that movement of the golfer's body is restricted to a vertical pivotal axis. Notably, the Ungar reference does not appear to restrict reverse rotation of a golfer's hips such as during a backswing.

As may be apparent from a review of the above mentioned prior art references, many golf swing training apparatus appear to be directed toward limiting relative motion of certain portions of a golfer's body in an attempt to teach, through muscle memory, a specific swing concept through repetitive practicing of a particular swing pattern. More particularly, each of the above mentioned prior art references appear to disclose a swing pattern wherein either lateral movement of a golfer's hips or reverse rotation of a golfer's hips is restricted or altogether prevented.

As such, none of the prior art references appear to stabilize the lower body (i.e., lower legs and hips) in a manner which maximizes the amount of potential energy that is generated during the golfer's backswing. Furthermore, none of the prior art references are understood to disclose or even suggest that restricting or preventing reverse hip rotation and lateral hip movement during the backswing as a means for increasing potential energy generated during the backswing and which can be released as kinetic energy during forward rotation of a golfer's hip during the downswing and follow through.

In this regard, nowhere in the prior art is there understood to be disclosed a swing training device for a swing pattern which restricts unnecessary body movement in order to maximize potential energy build-up while permitting movement of the lower body in other directions which enhances stability during the backswing, downswing and follow through portions. As was mentioned above, such particular swing pattern is believed to improve driving distance of the golfer as well as increase consistency of each swing by forcing better core rotation (i.e., rotation of the spine during the backswing) while preventing lateral or sideways motion (i.e., left-to-right) motion of the hips. It is believed that the combination of restricting lateral motion and preventing reverse rotation of the hips draws the focus of the golf swing away from the upper torso and concentrates movement on the lower body portions in order to maximize generation of power.

As can be seen, there exists a need in the art for a swing training device which teaches, through repetitive practice and muscle memory, a swing pattern which restricts the golfer's lower body in certain movements while allowing rotation and other movements in order to enhance stability during the golf swing. More specifically, there exists a need in the art for a swing training device which ensures better core (i.e., spinal) rotation of the golfer's upper torso during the backswing while restricting lateral (i.e., sideways) motion of the hips in order to force the golfer to use the lower portion of the body (i.e., the legs) in order to release the potential energy build-up. Furthermore, there exists a need in the art for a swing training device which is of simple construction, light weight and low cost.

BRIEF DESCRIPTION OF THE DRAWINGS

These as well as other features of the present invention will become more apparent upon reference to the drawings wherein.

DETAILED DESCRIPTION

Figure 1:
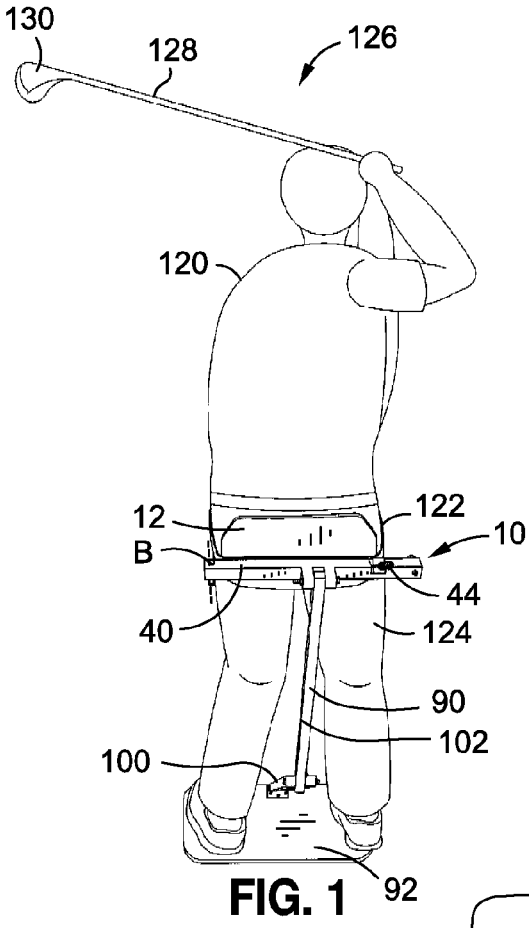
FIG. 1 is a perspective view of a right-handed golfer operatively engaged to a swing training device in accordance with one aspect of the present invention and further illustrating the golfer gripping a golf club at the top of the backswing.

Referring now to the drawings wherein the showings are for purposes of illustrating preferred embodiments of the present invention and not for purposes of limiting the same, shown in FIGS. 1-20 is a swing training device 10 which is specifically adapted to prevent lateral movement of a golfer's hips 122 during the backswing, downswing and follow through portions of a golfer's swing. Furthermore, the training device 10 is specifically adapted to prevent reverse rotation of a golfer's hips 122 (i.e., away from the intended flight path of the golf ball) and only allowing forward rotation of the golfer's hips 122 during the downswing and follow through portions of the golfer's swing. It should also be noted that FIGS. 1-20 illustrate the training device 10 in an embodiment configured for a right-handed golfer 120. However, the training device 10 may be configured for a left-handed golfer 120 wherein the components that make up the training device 10 are manufactured and assembled in mirror image to the device illustrated in FIGS. 1-20.

Advantageously, the training device 10 restricts lower body 124 movement in order to maximize the generation of potential energy during the backswing. In this regard, the upper torso, and more particularly, the golfer's shoulders necessarily rotate in a reverse direction during the backswing in order to maximize potential energy due to rotation of the upper torso or core rotation of the gofer's body. As a result of restriction of the golfer's hips 122 in the lateral and rotational directions, such core rotation allows the right side of the lower body 124 to rotate toward the target during the downswing and follow through with strong leg drive to maximize driving distance.

As will be described in greater detail below, the training device 10 includes a latch mechanism 42 which may be provided in a variety of embodiments and which is specifically adapted to prevent forward rotation of the golfer's hips 122 until a predetermined tension threshold force releases the latch mechanism 42 to allow forward hip rotation. Ideally, the forward hip rotation occurs during the downswing portion and causes momentum of the golfer's body to rotate toward the target as the left side of the golfer's body pivots around the golfer's left leg as will be described in greater detail below.

Referring more particularly to FIGS. 1-4, shown is the training device 10 which, in its broadest sense, comprises a seat assembly 12 configured to be mounted to the golfer's hips 122 and a horizontal arm assembly 40 coupled to the seat assembly 12. The horizontal arm assembly 40 is configured to be pivotable about a seat pivot axis B preferably located on a left side 28 of the seat assembly 12. The horizontal arm assembly 40 is configured to prevent reverse pivoting of the seat assembly 12 during the golfer's backswing such that reverse rotation of a golfer's hips 122 is prevented.

The swing training device 10 further comprises a vertical arm assembly 90 coupled to the horizontal arm assembly 40 and which is configured to allow movement of the golfer's hips 122 in the upward and downward directions as well as forward and backward. However, the vertical arm assembly 90 is specifically configured to prevent lateral movement, (i.e., sideways or left-to-right movement) of the golfer's hips 122. Although the vertical arm assembly 90 is illustrated as comprising a series of arms pivotally connected to one another, it should be recognized herein that the training device 10 comprising the seat assembly 12 and horizontal arm assembly 40 may be fixedly secured to any structure or supporting surface which allows the horizontal arm assembly 40 to freely move upward and downward as well as forward and backward. For example, it is contemplated that the seat assembly 12 and horizontal assembly may be fixedly secured to a wall structure having a pivotal telescopic mechanism 74 extending outwardly therefrom and which can prevent lateral movement of the seat assembly 12 while allowing movement thereof in all other directions.

Figure 3:
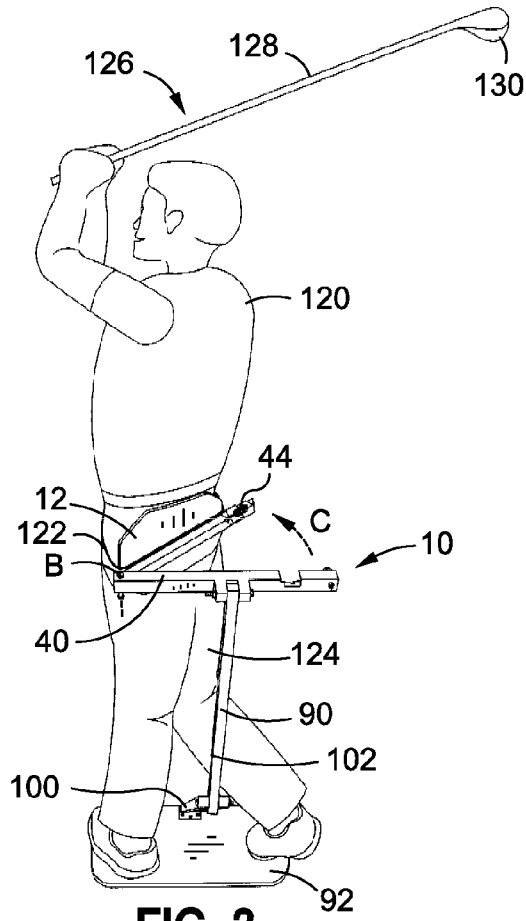
FIG. 3 is a perspective rear view of the swing training device wherein the golfer progressed to the follow through portion of a golf swing and further illustrating forward rotational motion of the golfer's hips as permitted by the swing training device.
Figure 4:
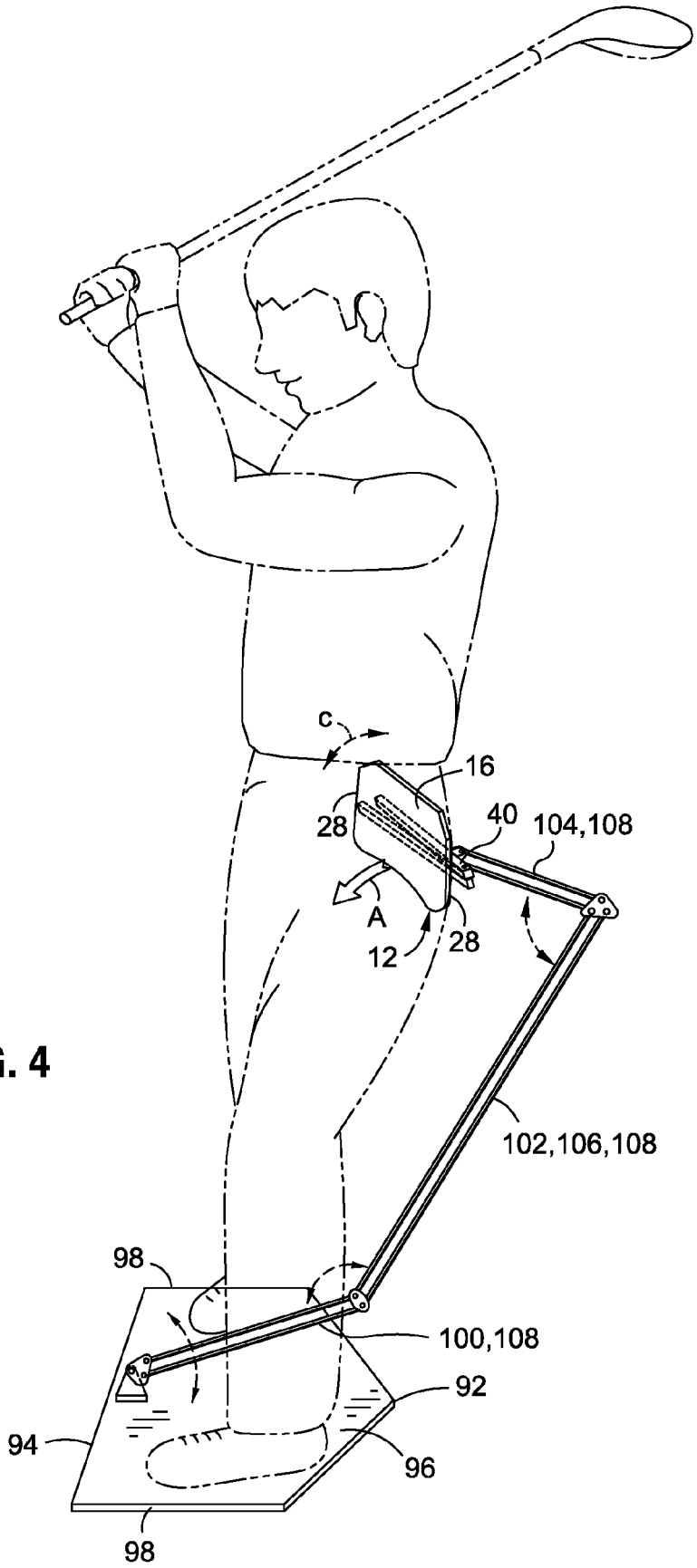
FIG. 4 is a perspective side view of the swing training device illustrating a platform having a vertical arm assembly pivotally extending upwardly therefrom and being connected to a seat assembly for engagement to the golfer.

Referring more particularly to FIG. 4, the vertical arm assembly 90 may comprise a fixation mechanism such as a platform 92 which is configured to support the golfer 120 standing thereupon. As can be seen in the figures, the platform 92 utilizes the body weight of the golfer 120 in order to anchor or non-movably fix the training device 10 to the ground or other supporting surface and prevent movement during the golf swing. Although the platform 92 is shown in a four-sided shape in FIGS. 1-3 and a five-sided shape in FIG. 4, it should be recognized that the platform 92 may be provided in any shape, size and configuration suitable for stabilizing the golfer 120 standing thereupon.

Referring still to FIGS. 1-4, the platform 92 generally includes forward, aft and side portions 94, 96, 98 with the vertical arm assembly 90 pivotally coupled to the platform 92 at the forward portion 94 thereof. In this regard, the vertical arm assembly 90 is preferably configured to be releasably secured thereto such as via a quick release pin 74 such that the platform 92 may be removed from the vertical arm assembly 90 for transportation and storage. As can be seen in FIG. 4, a pivot bracket 70 may be mounted in a centralized area of the forward portion 94 of the platform 92 and extends backwardly therefrom.

Figure 2:
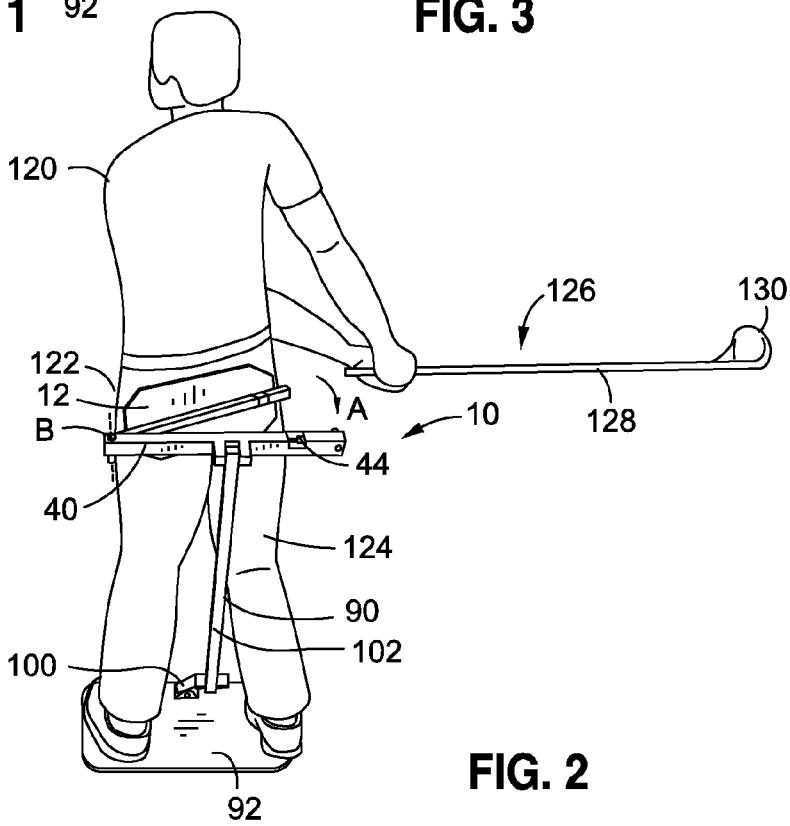
FIG. 2 is a perspective rear view of the swing training device wherein the golfer has progressed to the downswing and illustrating restrictive movement of the golfer's hips by the swing training device.

Ideally, the vertical arm assembly 90 is positioned such that the golfer's legs straddle the vertical arm assembly 90 as shown in FIGS. 1-3. However, it is recognized herein that the vertical arm assembly 90 may be attached to any location on the platform 92 such as, for example, an arrangement where the golfer's legs are disposed on one of opposing sides of the vertical arm assembly 90. It is also further contemplated that the vertical arm assembly 90 may extend upwardly from any portion of the platform 92 other than the forward portion 94.

Referring still to FIGS. 1-4, the vertical arm assembly 90 may comprise a lower arm 100 extending from the platform 92 forward portion 94 and being interconnected to an intermediate arm 102 and an upper arm 104. Each of the intermediate and upper arms 102, 104 are configured to be pivotally connectable to the lower arm 100 in order to allow a full range of unobstructed vertical motion by the golfer's lower portion (i.e., hips 122 and legs) during all phases of the golf swing.

For example, as best seen in FIG. 3, the lower arm 100 extends aftwardly from the forward portion 94 of the platform 92 to prevent contact with the golfer's right knee which typically moves forward during the follow through. In addition, the intermediate arm 102 may be provided with the telescopic mechanism 106 to provide for length adjustability of the vertical arm assembly 90 to accommodate golfers 120 of different heights and hip levels. The telescopic mechanism 106 may be optionally included in at least one of the lower, upper and intermediate arms 100, 102, 104.

Even further, the vertical arm assembly 90 may be comprised of any number of arms other than the lower, intermediate and upper arms 100, 102, 104 shown in FIG. 4. For example, FIGS. 1-3 illustrate the vertical arm assembly 90 having only a lower arm 100 and an intermediate arm 102 connected directly to the horizontal arm assembly 40. In addition, any one of the arm members of the vertical arm assembly 90 may be provided in a four-bar-linkage 108 configuration in order to maintain a desired angular orientation of the vertical arm assembly 90/seat assembly 12. As may be appreciated, providing the vertical arm assembly 90 in a four-bar-linkage 108 arrangement may provide a further body control aspect to the training device 10 in that the seat assembly 12 maintains the hips 122 of the golfer 120 in a specific orientation in order to teach the above-described swing pattern.

Regardless of its particular configuration, the vertical arm assembly 90 is specifically adapted to limit movement of the seat assembly 12 within a specific plane wherein the seat assembly 12 and, hence, the golfer's hips 122 may move upwardly, downwardly, forwardly and aftwardly. At the same time, the vertical arm assembly 90 prevents movement of the seat assembly 12 out-of-plane wherein the vertical arm assembly 90 prevents lateral motion of the seat assembly 12 and prevents rotational motion of the horizontal arm assembly 40. For example, as illustrated in FIG. 1, the golfer 120 is strapped to the seat assembly 12 and is shown gripping the golf club 126 with the shaft 128 and club head 130 positioned at an apex or top of the backswing. During the take away and through the backswing, the golfer's hips 122 are restricted from lateral (i.e., sideways) movement as well as restricted from rotation in the reverse direction (i.e., away from the desired flight path of the golf ball).

In FIG. 2, the golfer 120 has progressed to the downswing portion prior to striking the ball and wherein the golfer's hips 122 are restricted from lateral motion and from rotation in the reverse and forward directions. In FIG. 3, the golfer 120 has progressed to the follow through portion of the golf swing wherein the seat assembly 12 has released from the horizontal arm assembly 40 due to the attainment of the tension threshold force which then allows the seat assembly 12 and, hence, the golfer's hips 122 to rotate in the forward direction (i.e., toward the direction of flight of the golf ball). In each of these sequences illustrated in FIG. 1 to FIG. 3, it can be seen that the training device 10 restricts lateral movement of the golfer's hips 122 in all phases of the golf swing and only allows forward rotation of the golfer's hips 122 at a specific point during the downswing portion.

Referring now to FIGS. 5-10, shown is the horizontal arm assembly 40 comprising a latch mechanism 42. The latch mechanism 42 of the training device 10 is specifically configured to release the seat assembly 12 upon attainment of the predetermined tension threshold force as exerted by the golfer 120 during forward rotation of the golfer's hips 122. As best seen in FIG. 3, the seat assembly 12 is shown in the forwardly pivoted direction following release of the latch mechanism 42. In this manner, the seat assembly 12 prevents reverse rotation (i.e., away from the direction of flight of the golf ball) and only allows forward rotation of the golfer's hips 122 wherein the seat assembly 12 pivots forwardly about a seat pivot axis B located on its left side as best seen in FIG. 3.

Figure 5:
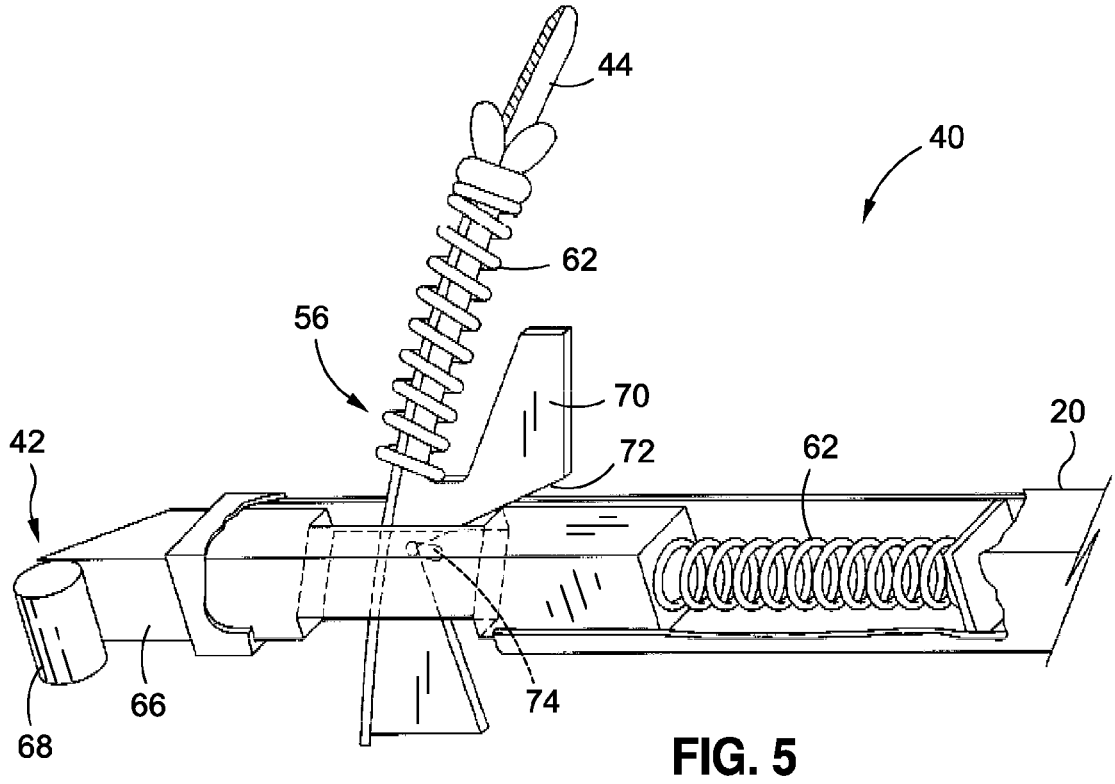
FIG. 5 is an enlarged partial cross sectional view of a horizontal arm assembly having a latch mechanism specifically configured to hold the hips back and when opened, generates momentum (i.e., power) at the golfer's hips with the latch mechanism being configured to release the seat assembly for pivoting upon attainment of a tension threshold force.
Figure 6:
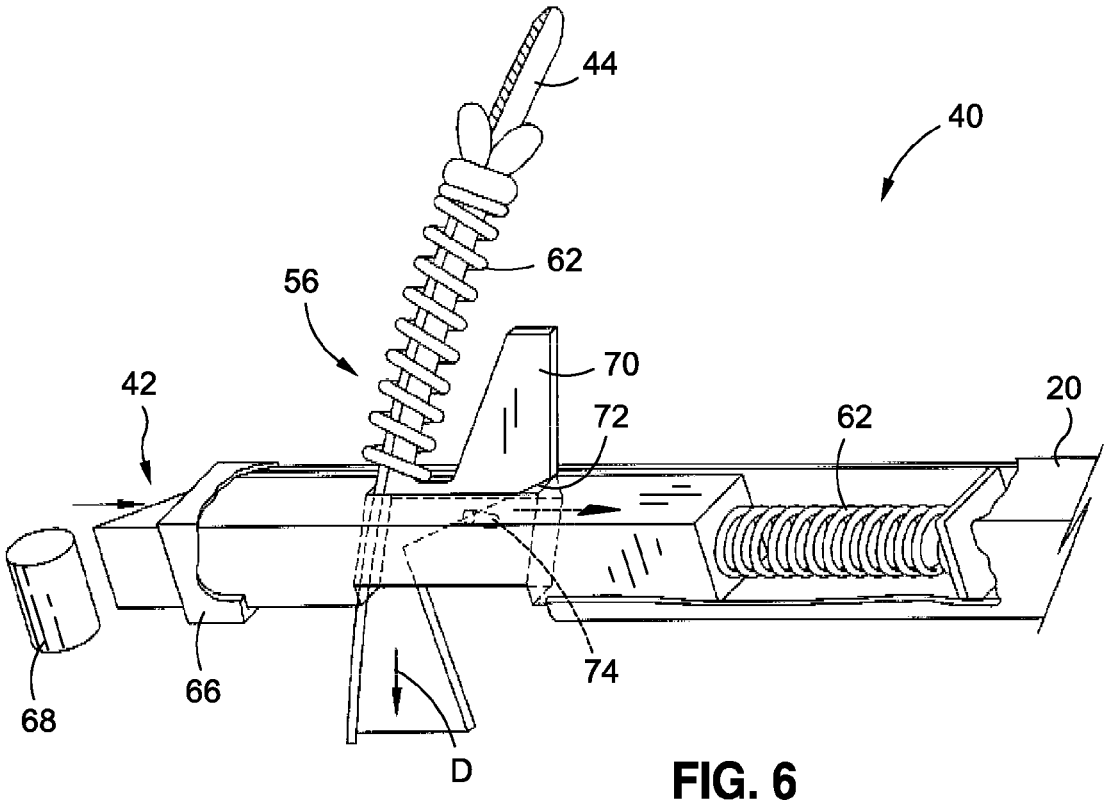
FIG. 6 is an enlarged partial cross sectional view of the latch mechanism in one configuration illustrating a slider disengaged from a roller in order to allow release of the seat assembly for pivoting.

FIGS. 5-11 illustrate the arrangement and operation of the latch mechanism 42 in an embodiment comprising a lock assembly 64 having a mechanical biasing member 62 (e.g., compression spring) to release the seat assembly 12 from the horizontal arm assembly 40 at the appropriate point during the golfer's downswing. As can be seen in FIGS. 5 and 6, the latch mechanism is incorporated into a pivot member 20 which is releasably engageable to a stationary member 18. The pivot member 20 and stationary member 18 are shown in the joined position in FIGS. 1 and 2 and in the released position in FIG. 3. The pivot member 20 has a free end 24 and a pivot end 22 which is pivotally coupled to the stationary member 18 at the seat pivot axis B. FIGS. 5 and 6 illustrate the free end 24 of the pivot member 20 which includes the latch mechanism 42.

FIG. 5 is an enlarged partial view of the free end 24 of the pivot member 20 wherein a slider 66 of the pivot member 20 is locked behind a roller 68 of the stationary member 18. FIG. 6 is an enlarged view illustrating retraction of the slider 66 within the pivot member 20 in response to the application of the tension threshold force on a pull tab 80 along a direction indicated by the arrow D.

Figure 7:
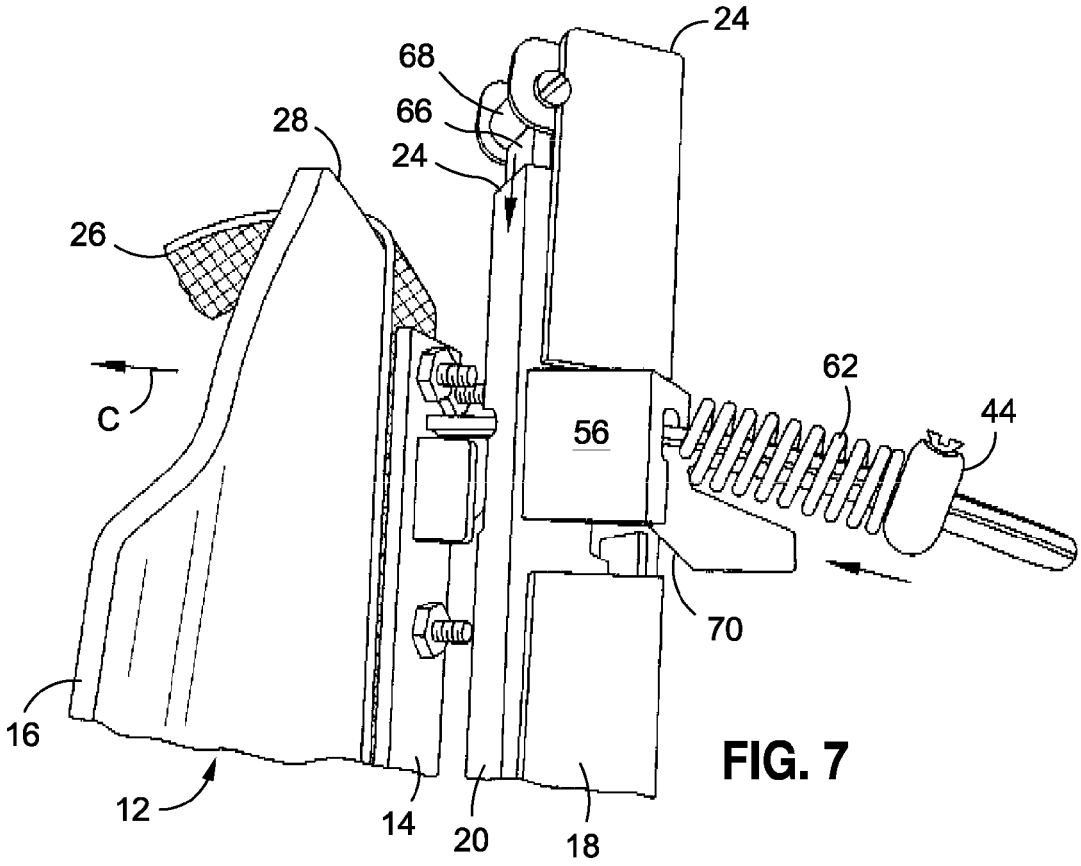
FIG. 7 is an enlarged perspective view of the latch mechanism in one embodiment in a locked position.
Figure 8:
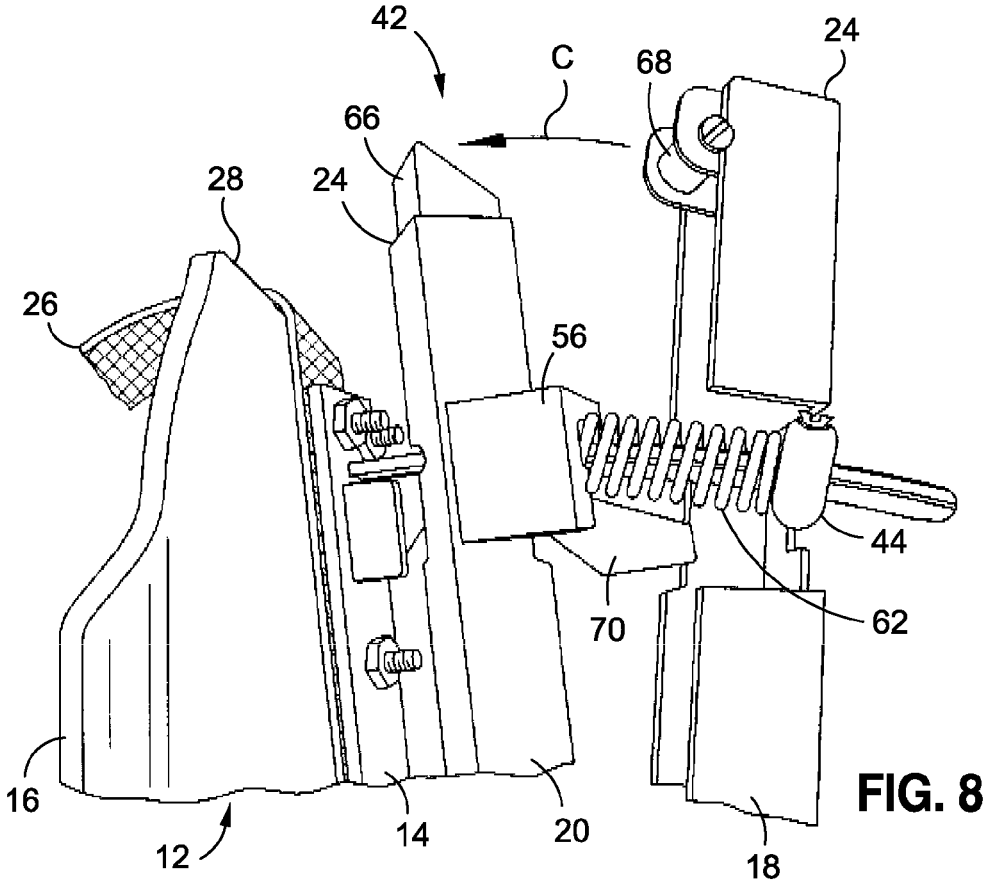
FIG. 8 is an enlarged partial perspective view of the latch mechanism of FIG. 7 in the released position.

FIG. 7 is an enlarged partial perspective view of the latch mechanism 42 similar to that which is illustrated in FIG. 5 and illustrating retraction of the slider 66 from the roller 68 in order to allow release of the seat assembly 12 from the horizontal arm assembly 40. FIG. 8 illustrates the forward rotational movement of the seat assembly 12 after release of the latch mechanism 42.

Figure 9:
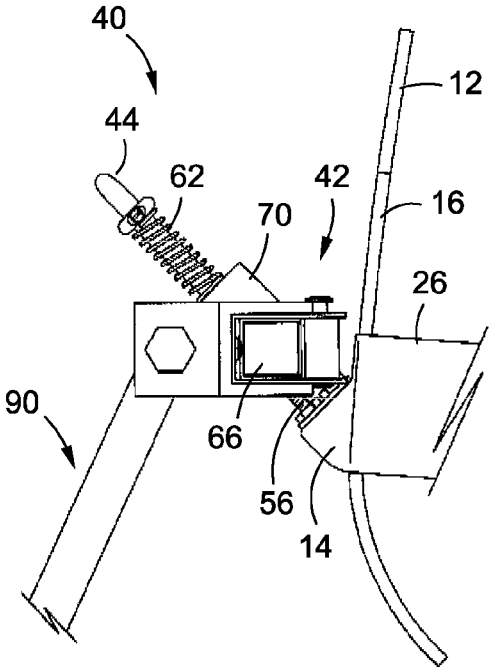
FIG. 9 is a partial side view of the latch mechanism in one embodiment illustrating a seat back engaged to the vertical arm assembly with the latch mechanism in the locked position.
Figure 10:
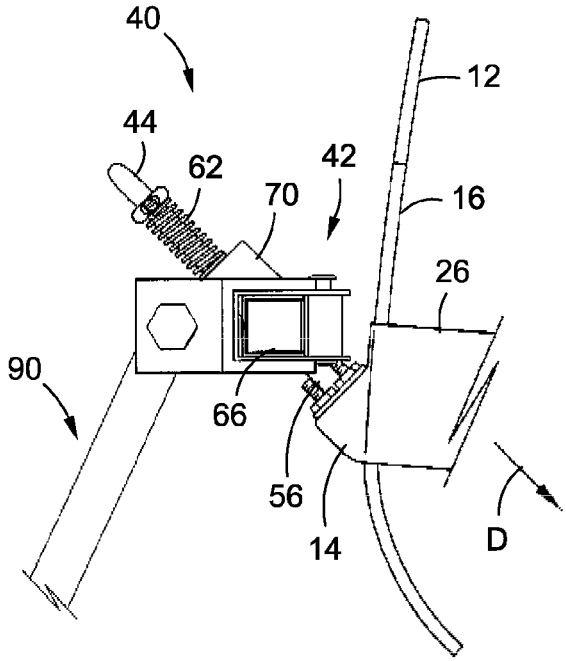
FIG. 10 is a partial side view of the seat assembly and horizontal arm assembly illustrating the directional orientation of the tension threshold force exerted on the latch assembly just prior to release thereof.
Figure 15:
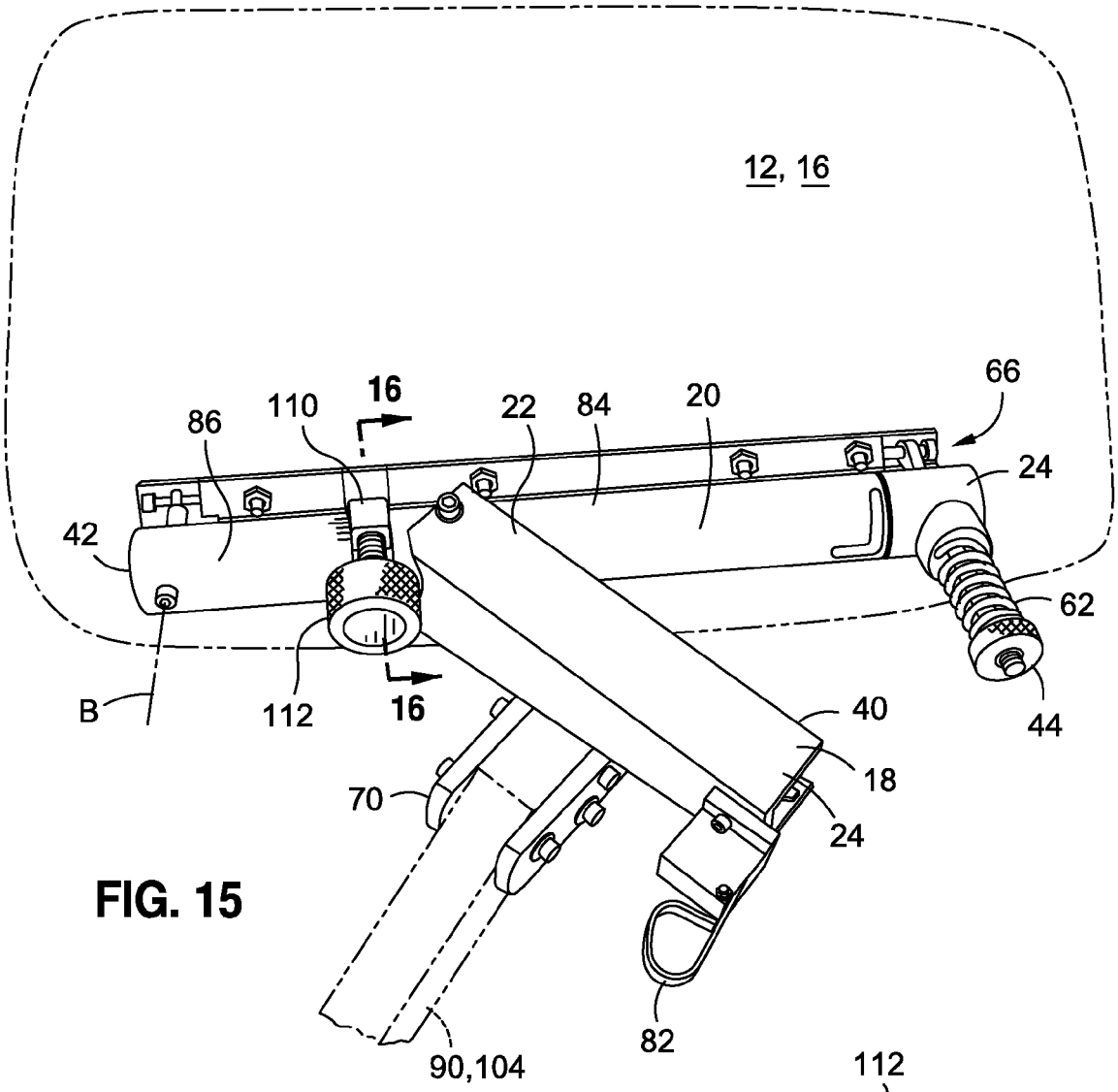
FIGS. 15 is a perspective view of an additional embodiment similar to that which is shown in FIGS. 5-11 and further including a pitch adjust collar in an arrangement wherein the seat assembly is pivotably adjustable to accommodate golfers of different height and to help certain golfers that "stand up" on their follow though to swing down at a steeper angle on the downswing.
Figure 16:
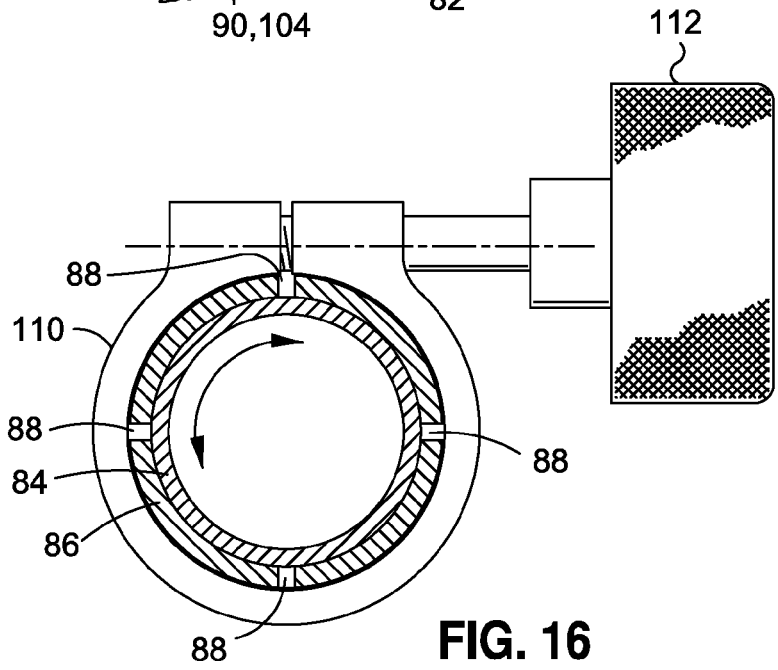
FIG. 16 is a cross sectional view of the pitch adjust collar shown in FIG. 15.
Figure 17:
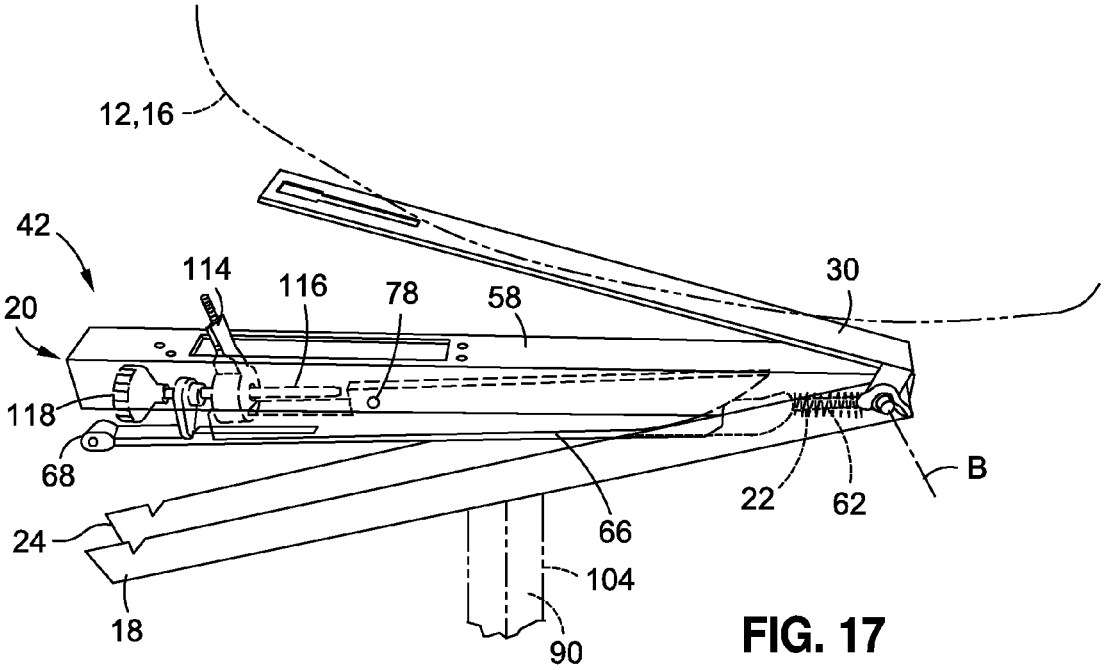
FIG. 17 is a perspective view of an additional embodiment of the horizontal arm assembly.
Figure 18:
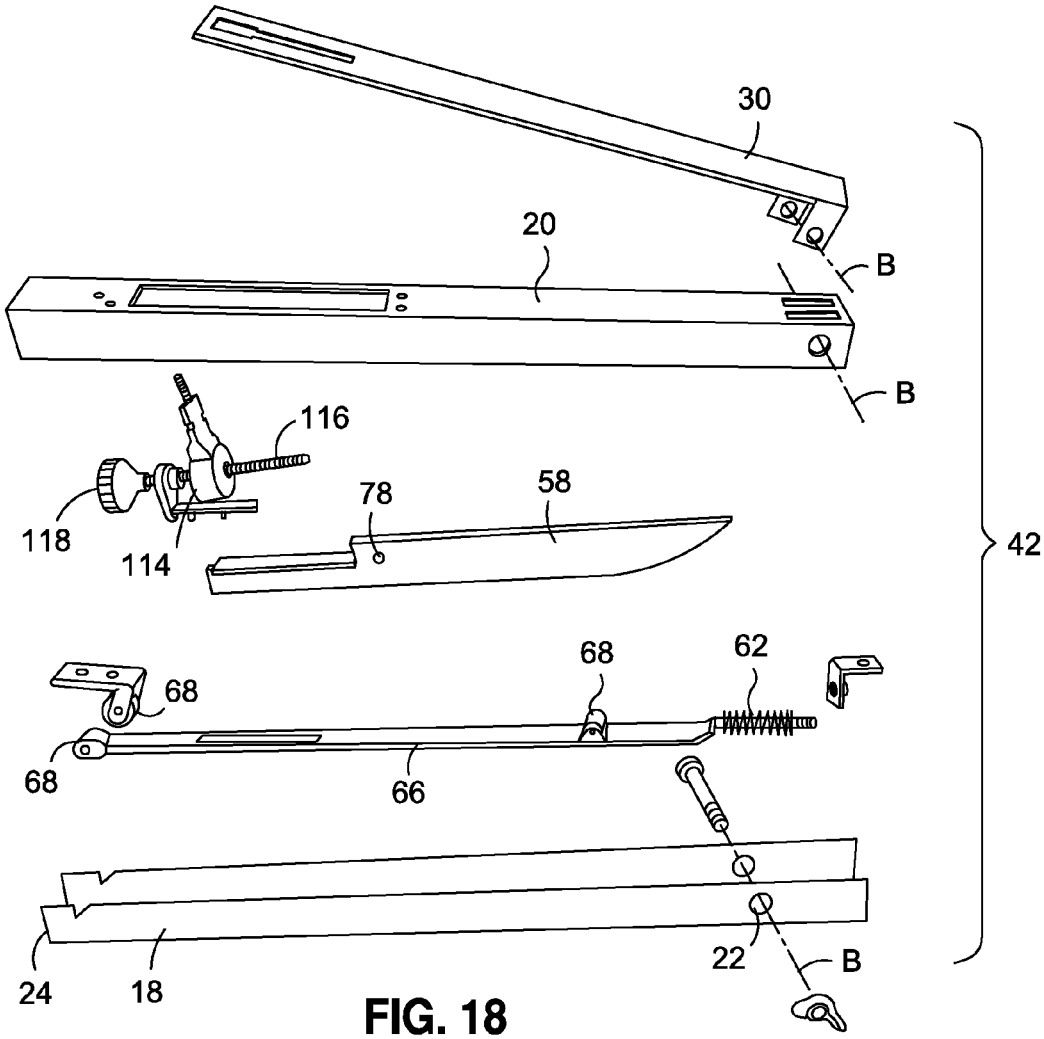
FIG. 18-20 are exploded views of the latch mechanism and a cross sectional view of the sliding adjuster for adjusting the tension threshold at which the latch mechanism releases.

FIG. 9 illustrates the latch mechanism 42 in a locked position wherein the seat assembly 12 is coupled to the horizontal arm assembly 40 by the latch mechanism 42. FIG. 10 illustrates the application of the tension threshold force in a slightly downwardly angled orientation illustrated by the arrow D. As will be described in greater detail below, the latch mechanism 42 is preferably configured such that directional orientation D of the tension threshold force is in general alignment with a plane defined by the golfer's hip movement during the downswing portion. As is shown in FIGS. 15-16, adjustment of the latch mechanism 42 may be facilitated by a pivot adjust collar 110 as will be described in greater detail below.

Figure 11:
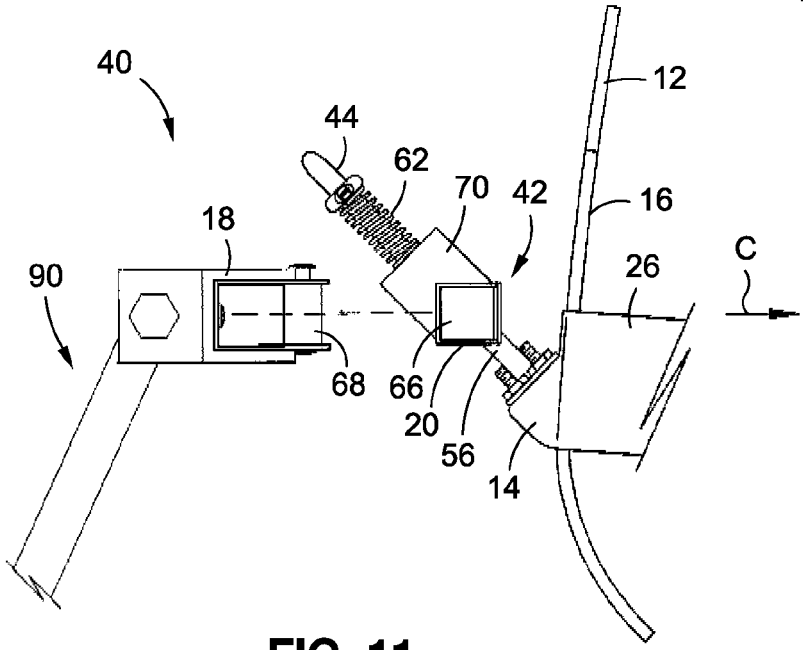
FIG. 11 is an enlarged partial side view illustrating the seat assembly pivotally disengaged or released from the vertical arm assembly in order to allow forward rotation of the golfer's hips.

FIGS. 9-11 illustrate the orientation of the mechanical latch mechanism 42 in a general alignment with the direction D of the tension threshold force at the instant of release of the latch mechanism 42. In this regard, the golfer's hips 122 define a specific hip movement during the downswing which is believed to be a combination of forward rotational motion in a lateral direction in combination with a slightly downward movement of the right side of the golfer's hips 122. The resulting combination of forward rotation and downward motion by the golfer's hips 122 is believed to be generally along the orientation of the arrow D and which is preferably in alignment with the latch mechanism 42.

Referring particularly to FIGS. 5-11 illustrating the construction of the latch mechanism 42, the slider 66 may be configured with a generally rectangular cross sectional shape that is complementary to the interior of the pivot member 20. Furthermore, as shown in FIGS. 5 and 6, the slider 66 may be biased toward an outwardly extended position by a biasing member 62 which may be disposed inside the hollow tubular configuration of the pivot member 20. The biasing member 62 is shown configured as a compression spring or coil spring. However, any suitable configuration for biasing the slider 66 in an outwardly extended orientation may be utilized. In this regard, the biasing member 62 maintains the slider 66 in a locked engagement with the roller 68 until attainment of the tension threshold force exerted upon the bracket 70.

The slider 66 is forcefully retracted within the pivot member 20 under the influence of the downwardly angled force along the direction of the arrow D illustrated in FIG. 10. The biasing member 62 further facilitates re-engagement of the latch mechanism 42 due to the combination of the beveled end of the slider 66 and the rotatable roller 68 to which it engages. In this regard, the latch mechanism 42 can be easily moved into locking engagement by simply pivoting the seat assembly 12 back toward the horizontal arm assembly 40 until the slider 66 latches behind the roller 68.

Referring still to FIGS. 5 and 6, the slider 66 may include a diagonal cutaway portion in order to allow clearance with the bracket 70. The bracket 70 may include a threaded shaft extending outwardly therefrom and onto which the biasing member 62 may be coaxially mounted with an adjustment nut (e.g., a wing nut). The adjustment nut provides a means for adjusting the tension threshold force required to release the latch mechanism 42. The bracket 70 includes a pair of ramp 72 surfaces which are slidably engageable to a pin 74 extending outwardly from opposing sides of the slider 66.

As best seen in FIGS. 5, 6 and 8, the pivot member 20 and stationary member 18 may each include a partial cutaway in order to allow for obstruction-free movement of the latch mechanism 42. More particularly, the cutaways in the stationary member 18 and pivot member 20 allow the bracket 70 to extend through the slider 66 and to move freely relative to the slider 66 under the influence of the tension threshold force.

In operation, the application of the tension threshold force along the direction of the arrow D induces relative lateral movement of the bracket 70 which, in turn, bears against the pin 74 forcing the slider 66 to axially retract into the hollow confines of the pivot member 20. In this regard, the tension threshold force acts against a combination of the spring force of the biasing member 62 mounted on the threaded shaft as well as acting against the spring force applied by the biasing member 62 bearing against the end of the slider 66. The amount of tension threshold force can be adjusted by rotatably adjusting the adjustment nut mounted on the threaded shaft in order to compress or expand the compression spring and thereby alter the spring force.

Alternatively, the tension threshold force can be adjusted by incorporating the biasing member 62 (i.e., compression spring) having a different spring constant or spring rate. For example, stronger or heavier golfers 120 may require a relatively larger tension threshold force in order to allow forward rotational release of the seat assembly 12 at the appropriate point during the downswing. Conversely, lighter weight golfers 120 or those possessing less body strength may be better suited with a compression spring having a smaller spring constant or lower spring rate to allow release of the latch mechanism 42 at the appropriate point during the downswing. In this regard, the biasing member 62 may function as an adjustment mechanism 44 which is operatively coupled to the latch mechanism 42 and which is configured to allow selective adjustment of the tension threshold force.

Referring briefly now to FIGS. 9-11, the latch mechanism 42 can be seen oriented in general alignment with the direction at which the tension threshold force may be applied as induced by the movement of the golfer's hips 122. Ideally, the direction or plane of movement of the golfer's hip rotation indicated by the reference character A is preferably in alignment with the direction D of the tension threshold force as applied to the latch mechanism 42. In this regard, the swing training device 10 of the present invention is preferably configured to allow angular adjustment of the latch mechanism 42 such that direction D of the tension threshold force is in general alignment with the plane defined by the plane or rotation A of the golfer's right hip 122 at the instant of release of the latch mechanism 42.

As was earlier mentioned, the release of the latch mechanism 42 preferably occurs during the downswing portion. It should be noted that the golfer's hips 122 and, in particular, the golfer's right hip 122 undergoes a complex set of movements which typically is not characterizable as movement along a plane of rotation. However, for purposes of the present invention, it is contemplated that at the instant of release of the latch mechanism 42, the movement of the golfer's right hip 122 is preferably in alignment with the directional orientation of the tension threshold force as applied in the direction of a bracket 70 indicated by the arrow D in FIG. 10.

Furthermore, because of the wide variety in heights and body strength of different golfers as well as wide variations in swing patterns between golfers, the swing training device 10 is preferably configured such that the angular orientation of the latch mechanism 42 is selectively adjustable to match the golfer's swing. In this manner, the training device 10 is suitable for use by a wide variety of golfers and is not necessarily limited to or optimized for a specific swing pattern.

Referring to FIGS. 7-11, the seat assembly 12 comprises a stationary member 18 which is connected to the horizontal arm assembly 40 in fixed orientation as best illustrated in FIGS. 1-3. Furthermore, the seat assembly 12 comprises the pivot member 20 which is pivotally coupled to the stationary member 18 at the seat pivot axis B as best seen in FIGS. 1-3. As was earlier mentioned, the pivot of the pivot member 20 is illustrated in FIGS. 5-8 wherein the free end 24 further comprises the latch mechanism 42 and the adjustment mechanism 44 which provide releasable coupling of the seat assembly 12 to the horizontal arm assembly 40.

Also shown in FIGS. 7-8 is a seat frame 14 which preferably includes a padded portion for bearing against the seat of the golfer 120. The seat assembly 12 may further include a system of straps wrapping around the torso and/or the thighs of the golfer 120 to non-movably secure the seat assembly 12 to the golfer's hips 122. In this regard, the seat straps 26 secure a seat back 16 to the golfer 120. The seat back 16 is, in turn, mounted on a seat frame 14 which is pivotally mounted to the pivot member 20 via the bracket 70 illustrated in FIGS. 5 and 6. In this regard, the seat frame 14 transmits the tension threshold force as induced by forward rotational motion of the golfer's hips 122 during the downswing such that the latch mechanism 42 pivotally releases the seat assembly 12 from the horizontal arm assembly 40. The seat straps 26 may be secured to the seat back 16 in any suitable manner such as using mechanical fasteners illustrated in FIGS. 7 and 8 or by other suitable means such as bonding or integrally forming the seat straps 26 to the seat back 16.

Figure 12:
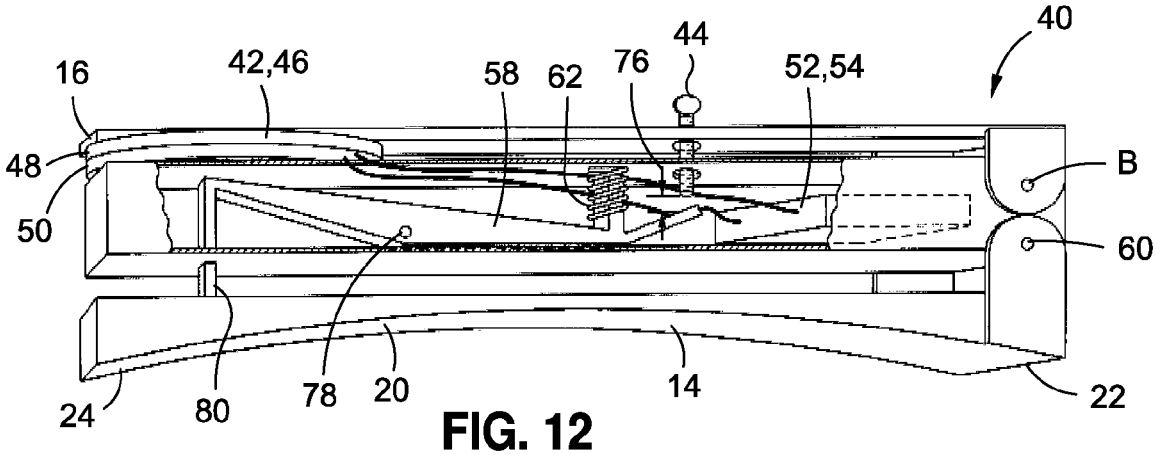
FIG. 12 is a perspective top view of the latch mechanism in one embodiment comprising an electromagnet assembly for maintaining the seat assembly in engagement to the horizontal arm assembly.
Figure 13:
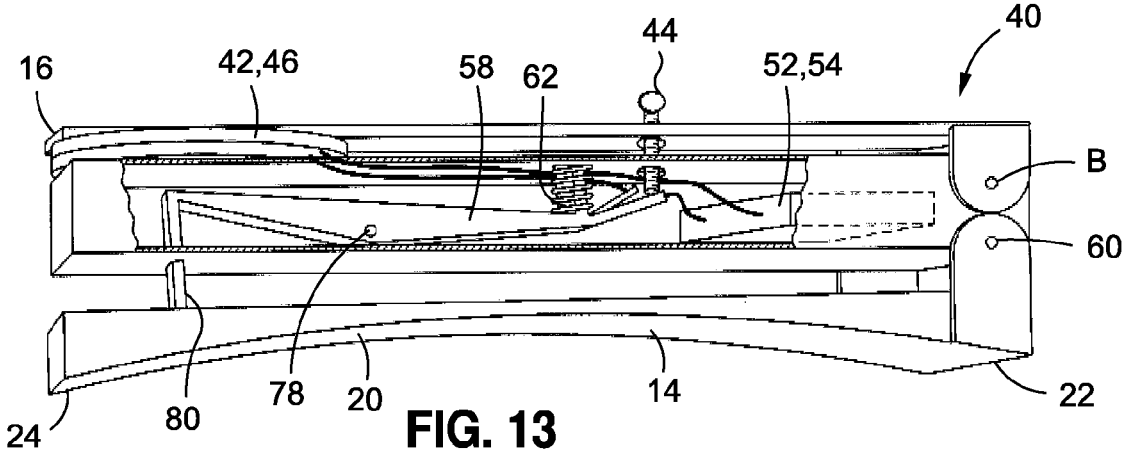
FIG. 13 is a perspective top view of the electromagnet assembly and illustrating a trigger mechanism comprising a leverage arm configured to deactivate the electromagnet assembly upon attainment of the tension threshold force exerted by the golfer's hips during the downswing.
Figure 14:
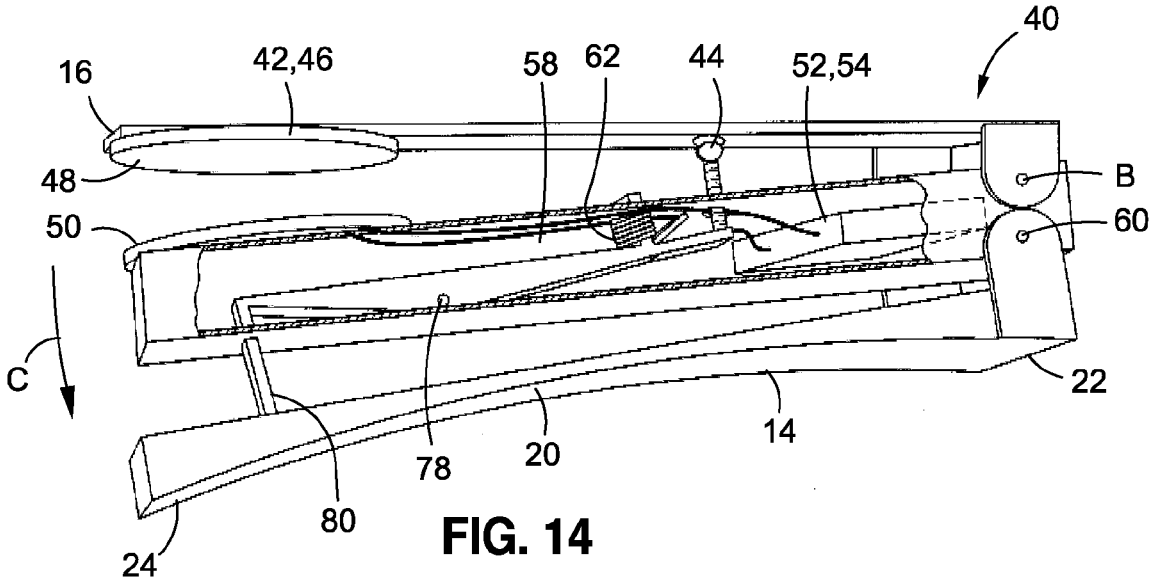
FIG. 14 is a perspective top view of the electromagnet assembly in the released position.

Referring now to FIGS. 12-14, shown is the latch mechanism 42 in an alternative embodiment illustrating an electromagnet assembly 46 configured to electromagnetically couple the free end 24 of the pivot member 20 to the stationary member 18 during activation or powering of the electromagnet assembly 46. In this regard, the electromagnet comprises a fixed portion 48 and a moveable portion 50 located adjacent a free end 24 of a pivot member 20 while the moveable portion 50 is preferably mounted in a complimentary position adjacent the free end 24 of the stationary member 18. The electromagnet assembly 46 may further include a power source 52 such as a battery 54 pack which may be installed within or which is moveable with the pivot member 20.

Conductive wires electrically connect the power source 52 to the moveable portion 50 of the electromagnet assembly 46 such that when the electrical circuit is complete, power or current is applied to the moveable portion 50 and thereby inducing magnetic attraction between the fixed portion 48 and the moveable portion 50. Alternatively, the power source 52 may be mounted on the stationary member 18 wherein conductive wires would then be preferably connected to the fixed portion 48 of the electromagnet assembly 46.

Deactivation of the electromagnet assembly 46 to allow for release of the latch mechanism 42 may be facilitated by a trigger mechanism 56. As can be seen in FIGS. 12-14, the trigger mechanism 56 may be comprised of a leverage arm 58 mounted within the hollow interior of the pivot member 20. The leverage arm 58 is pivotable about a trigger pivot axis 60 and includes a pair of tabs extending from a free end 24 of the leverage arm 58. One of the conductive wires extending to the fixed portion 48 of the electromagnet assembly 46 passes through the free end 24 such that during pivoting, the leverage arm 58 acts to alternately complete or break the electrical circuit from the power source 52 to the moveable portion 50.

A biasing member 62 biases the free end 24 of the leverage arm 58 away from a latch adjustment mechanism 44 configured as a simple threaded shaft with a thumb screw. When the latch mechanism 42 is in the locked position as illustrated in FIG. 12, the free end 24 of the leverage arm 58 creates a gap 76 with the adjustment mechanism 44 (i.e., thumb screw). However, as illustrated in FIG. 13, pivoting of the leverage arm 58 under the influence of forward rotation of the golfer's hips 122 causes contact between the free end 24 of the leverage arm 58 and the adjustment mechanism 44. The flow of electric current from the power source 52 to the moveable portion 50 is prevented which results in cancellation of the magnetic field between the moveable portion 50 and the fixed portion 48.

Deactivation of the electromagnet assembly 46 by pivoting of the leverage arm 58 thereby allows the pivot member 20 to be released from the stationary member 18 such that the seat frame 14 is then forwardly rotatable about the seat pivot axis B as best seen in FIG. 14. Adjustment of the tension threshold force in the embodiment of the latch mechanism 42 shown in FIGS. 12-14 may be facilitated by either replacing the biasing element (i.e., compression spring) with a higher spring constant (i.e., stiffer spring force) and/or axially adjusting the position and, hence, the gap 76 between the adjustment mechanism 44 (i.e., thumb screw) and the free end 24 of the leverage arm 58.

Figure 19:
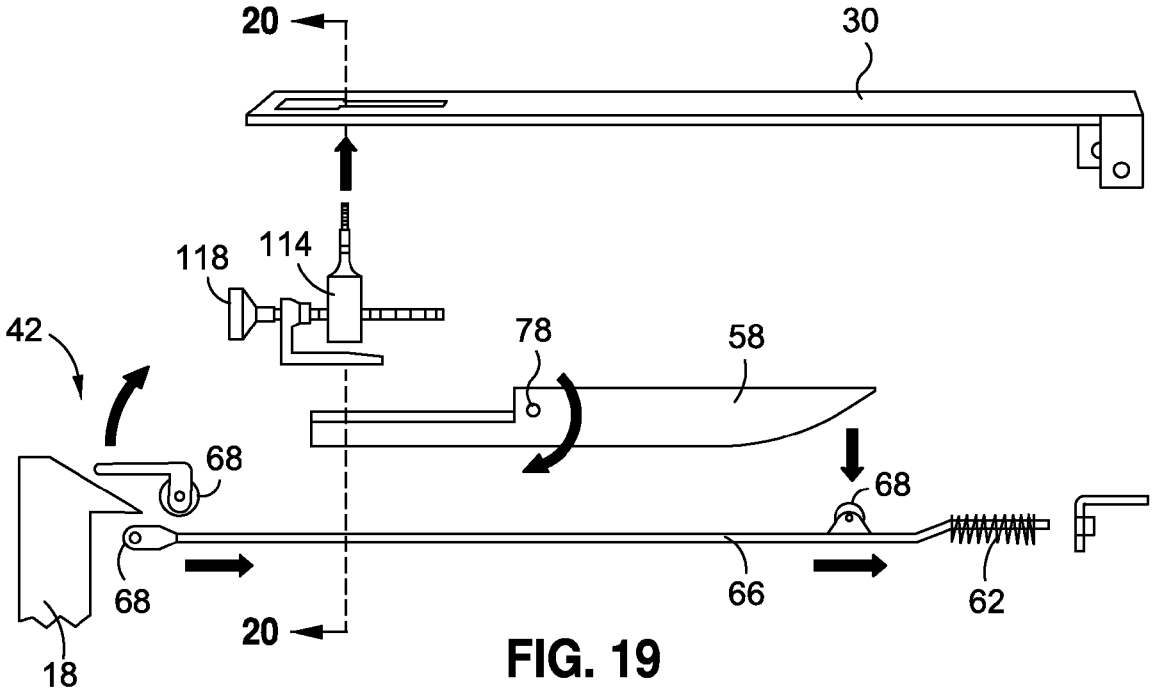
Figure 20:
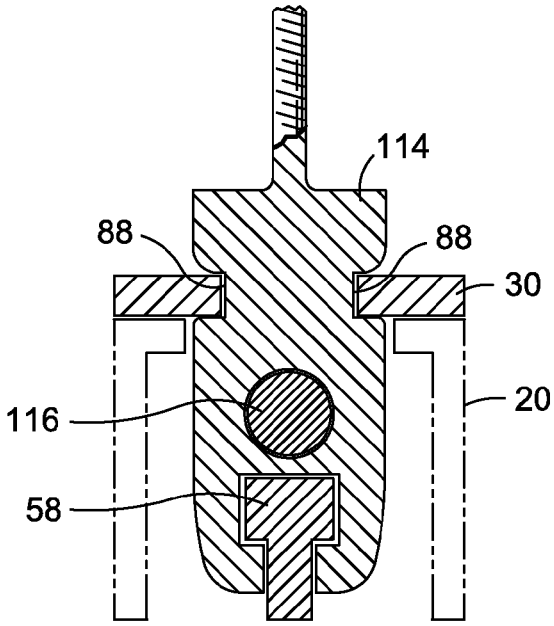

Referring now to FIGS. 17-20, shown is the latch mechanism 42 in a further mechanical embodiment similar in operation and functionality to that which was described above with regard to the latch mechanism 42 illustrated in FIGS. 5-11. The latch mechanism 42 of FIGS. 17-20 includes the slider 66 having a roller 68 disposed at one end. The latch mechanism 42 also includes a leverage arm 58 which is pivotable about a leverage pivot 78. The tension threshold force is adjustable by means of the adjustment mechanism 44 illustrated as an axially threaded rod 116 having a sliding adjuster 114 threadably engaged thereto. The sliding adjuster 114 is fixedly mountable to the leverage arm 58 and includes notches 88 that are slidable within a slot formed in the seat pivot 30 as best seen in FIG. 20. An upper portion of the sliding adjuster 114 is freely extendable through another slot formed in the pivot member 20. The pivot member 20 is pivotally coupled to the stationary member 18 by a kingpin located at a pivot end 22 of the stationary member 18.

Referring to FIG. 19, the seat pivot 30 is pivotably moveable with the pivot member 20 upon release of the latch mechanism 42. The seat assembly 12 is connected to a seat pivot 30 and to the adjustment mechanism 44. Upon attainment of the tension threshold force indicated by the vertical arrow and which is induced by forward rotation of the golfer's hips, the leverage arm 58 pivots about the leverage pivot 78 in the direction indicated by the curved arrow. The beveled portion of the leverage arm 58 then bears against a roller 68 in the direction of the arrow which then causes axial retraction of the slider 66 until the free end of the slider 66 disengages from the stationary member 18 at its free end 24 as indicated by the arrow.

Upon release of the pivot member 20 from the stationary member 18, the pivot member 20 and seat pivot 30 and the seat assembly 12 rotate about the seat pivot axis B (e.g., about the kingpin) to allow forward rotation of a golfer's hips during the downswing portion of the golfer's swing. Adjustment of the tension threshold force is facilitated by rotating the knob 118 which causes axial movement of the sliding adjuster 114 and which thereby alters the length of the moment arm against which the seat assembly 12 pulls against the leverage arm.

The change in moment arm causes an increase or decrease in the amount of tension threshold force that must be applied in order to overcome the biasing force of the biasing member 62. As was indicated earlier, the biasing member 62 biases the slider 66 into engagement with the stationary member 18 at the free end 24. In this manner, the latch mechanism is adapted to decouple the free end of the pivot member 20 from the stationary member 18 upon attainment of the desired tension threshold force. The trigger mechanism 42 as best seen in FIG. 19 comprises the leverage arm 58 which is pivotally mounted to the pivot member 20 and includes the biasing member 62 (i.e., compression spring) which ideally provides a biasing force equal to the tension threshold force required to decouple the latch mechanism 42.

Referring briefly to FIGS. 15-16, shown is the latch mechanism 42 in a preferred embodiment wherein the stationary member 18 is configured as a channel section and the pivot member 20 is configured as a tubular member pivotally connected to the channel section at the seat pivot axis B. The free ends 24 of the pivot member 20 and the stationary member 18 include a latch mechanism 42 arrangement that incorporates the trigger mechanism 56 similar to that which was described above with reference to FIGS. 1-11. The trigger mechanism 56 includes an adjustment mechanism 44 to adjust the tension threshold force at which the latch mechanism 42 releases the pivot member 20. Importantly, the latch mechanism 42 shown in FIGS. 15-16 incorporates a pivot adjust collar 110 which allows for pivotal adjustment of tubular sleeve arrangement which comprises the pivot member 20. As best seen in FIG. 16, the tubular sleeve arrangement comprises an inner sleeve 84 which is coaxially insertable into an outer sleeve 86. In this regard, the outer sleeve 86 may include at least one notch 88 to facilitate clamping of the inner sleeve 84 against rotational movement. The pivot adjust collar 110 may include a pivot adjust wheel 112 which facilitates manual clamping of the outer sleeve 86 with the inner sleeve 84 following adjustment of the angular orientation. In this regard, the swing training device 10 of the present invention is preferably configured to allow for angular adjustment of the latch mechanism 42 such that the direction D of the tension threshold force is in general alignment with the plane defined by the plane or rotation A of the golfer's right hip 122 at the instant of release of the latch mechanism 42. An on/off switch 82 may be provided as shown in FIG. 15 to deactivate the latch mechanism 42 and prevent the release thereof under the influence of the tension threshold force.

Additional modifications and improvements of the present invention may be apparent to those of ordinary skill in the art. Thus, the particular combination of parts described and illustrated herein is intended to represent only certain embodiments of the present invention and is not intended to serve as limitations of alternative embodiments or devices within the spirit and scope of the invention.

What is claimed is:

1. A golf swing training device adapted to prevent lateral movement and reverse rotation of a golfer's hips, the training device comprising:

a seat assembly configured to be mounted to the golfer's hips, the seat assembly defining opposing lateral seat sides;

a horizontal arm assembly coupled to the seat assembly and configured to be pivotable about a seat pivot axis located adjacent one of the seat sides, the horizontal arm assembly being configured to prevent reverse pivoting of the seat assembly such that reverse rotation of the golfer's hips is prevented; and a latch mechanism configured to release the seat assembly upon attainment of a tension threshold force exerted by forward rotation of the golfer's hips such that the seat assembly forwardly pivots about the seat pivot axis.

2. The golf swing training device of claim 1 further comprising:

a vertical arm assembly coupled to the horizontal arm assembly and being configured to prevent lateral movement of the golfer's hips.

3. The golf swing training device of claim 2 wherein the vertical arm assembly further includes:

a platform configured to support the golfer standing thereupon, the platform defining forward, aft and side portions;

a lower arm extending upwardly from the platform forward portion and being pivotally connected thereto; and at least one of an intermediate arm and an upper arm, the intermediate arm being configured to be pivotally connectable to the lower arm, the upper arm being configured to be pivotally connectable to the intermediate arm.

4. The golf swing training device of claim 3 wherein vertical arm assembly further includes:

a telescopic mechanism configured to provide length adjustability of the vertical arm assembly.

5. The golf swing training device of claim 2 wherein the vertical arm assembly is configured to be non-laterally moveable.

6. The golf swing training device of claim 5 wherein the vertical arm assembly includes at least one four-bar-linkage configured such that the seat assembly is non-vertically pivotable.

7. The golf swing training device of claim 1 wherein the horizontal arm assembly further includes:

an adjustment mechanism operatively coupled to the latch mechanism and being configured to allow for selective adjustment of the tension threshold force.

8. The golf swing training device of claim 1 wherein the latch mechanism is configured such that the directional orientation of the tension threshold force upon release of the latch mechanism is in general alignment with a plane of rotation of the golfer's hips.

9. The golf swing training device of claim 1 wherein the latch mechanism is configured to allow for adjustment of the magnitude of the tension threshold force.

10. The golf swing training device of claim 1 wherein the latch mechanism is configured such that the angular orientation thereof is selectively adjustable.

11. The golf swing training device of claim 1 wherein the seat assembly comprises:

a stationary member connected to the horizontal arm assembly; and a pivot member having a free end and a pivot end pivotally coupled to the stationary member and pivotable about the seat pivot axis.

12. The golf swing training device of claim 11 wherein the latch mechanism comprises:

a lock assembly mechanically coupling the free end of the pivot member to the stationary member at the seat pivot axis;

a trigger mechanism being adapted to decouple the free end of the pivot member from the stationary member upon attainment of the tension threshold force.

13. The golf swing training device of claim 12 wherein the trigger mechanism comprises a leverage arm pivotally mounted to the pivot member and including a biasing member providing a biasing force equal to the tension threshold force.

14. The golf swing training device of claim 1 wherein:

the seat assembly defines a seat angle relative to the horizontal arm assembly the golf swing training device being configured such that the seat angle is adjustable.

15. The golf swing training device of claim 1 wherein the latch mechanism comprises:

an electromagnet assembly configured to electromagnetically couple a free end of a pivot member to the stationary member during activation of the electromagnet assembly;

a trigger mechanism mechanically coupled to the pivot member and electrically coupled to the electromagnet assembly, the trigger mechanism being configured to deactivate the electromagnet assembly upon attainment of the tension threshold force such that the pivot member is released from the stationary member and is forwardly pivotable about the seat pivot axis.

16. The golf swing training device of claim 15 wherein the trigger mechanism comprises a leverage arm pivotally mounted to the pivot member and including a biasing member providing a biasing force.

17. The golf swing training device of claim 15 wherein the electromagnet assembly includes a power source mounted to the pivot member and being configured to induce magnetic attraction between the fixed portion and the movable portion.

18. The golf swing training device of claim 1 wherein the horizontal arm assembly is configured to be non-vertically pivotable.

* * * * *